US007356950B1

(12) United States Patent
Avery

(10) Patent No.: US 7,356,950 B1
(45) Date of Patent: Apr. 15, 2008

(54) KARAOKE CARD

(76) Inventor: Najiyyah Avery, 635 5th Ave. West, Apt 3, Hendersonville, NC (US) 28739

( * ) Notice: Subject to any disclaimer, the term of this patent is extended or adjusted under 35 U.S.C. 154(b) by 195 days.

(21) Appl. No.: 11/339,113

(22) Filed: Jan. 26, 2006

(51) Int. Cl.
*G09F 1/00* (2006.01)

(52) U.S. Cl. ..... 40/124.02; 40/124.03; 40/124.09; 40/124.11; 84/464 R

(58) Field of Classification Search ..... 40/124.02, 40/124.03, 124.09, 124.11; 84/464 A, 464 R
See application file for complete search history.

(56) References Cited

U.S. PATENT DOCUMENTS 3,462,157 A 8/1969 Barnett et al.
3,798,806 A * 3/1974 Sanford ..... 40/124.03
4,286,399 A * 9/1981 Funahashi et al. ..... 40/124.02
4,363,081 A * 12/1982 Wilbur ..... 362/98
4,381,558 A 4/1983 Bearden
4,497,126 A * 2/1985 Dejean ..... 40/124.02
5,063,698 A 11/1991 Johnson et al.
5,217,286 A * 6/1993 Ming-ho ..... 362/612
D341,850 S 11/1993 Reddock
5,761,836 A * 6/1998 Dawson ..... 40/124.03
5,860,065 A 1/1999 Hsu
6,130,773 A * 10/2000 Jacobson et al. ..... 359/296
7,239,320 B1 * 7/2007 Hall et al. ..... 345/473
2002/0152652 A1 * 10/2002 Pines ..... 40/124.03
2003/0192209 A1 * 10/2003 Yeh ..... 40/124.02
2005/0102867 A1 * 5/2005 Youngdahl ..... 40/124.11
2005/0226601 A1 * 10/2005 Cohen et al. ..... 386/75
2007/0072162 A1 * 3/2007 Honadel ..... 434/317

* cited by examiner

*Primary Examiner*—Gary C. Hoge

(57) ABSTRACT

The device includes a body with monolithically and pivotally conjoined first and second sections. The second section includes front and rear portions. The front and rear portions include a finger protruding orthogonally thereof. The fingers interlock to maintain the body at a unitary position. Such front and rear portions define a cavity. The front portion has a notch formed therein. The notch penetrates through the front portion and is in fluid communication with the cavity. The rear portion has a slot formed therein which is aligned with the notch and situated rearward of the cavity. A mechanism is included for playing a song when the first and second sections are articulated to an open position. A mechanism is included for illuminating a selected portion of the cavity while the song playing mechanism is activated. The illuminating mechanism lights up the lyrics of the song as the song is played.

18 Claims, 4 Drawing Sheets

KARAOKE CARD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to greeting cards and, more particularly, to a karaoke card for allowing a user to sing the lyrics of the song.

2. Prior Art

Greeting cards for special occasions are well known. Many greeting cards are enamored with colorful indicia to entertain the user as well as a myriad of shapes, colors and designs employed in the formation of the cards if not utilized on the card itself. As such, audible greeting cards have become known. The audible capability of the greeting card is advantageously provided quite inexpensively, providing the "talking card" may be merchandised within the price range of greeting cards, or only relatively slightly higher.

Consequently several examples of the prior art consist of cards with complex and/or impractical devices for audio playback which render them useless to the user due to their lack of longevity or difficulty of operation.

One example of aforementioned prior art discloses a card employing the use of a cassette tape player embedded in the body of the device. Such a device is cumbersome and succumbs easily to mechanical failure, thereby rendering the device inoperable.

Accordingly, a need remains for a karaoke card in order to overcome the above-noted shortcomings. The present invention satisfies such a need by providing a sing-along greeting card that is practical, inexpensive to manufacture, easy to operate, entertaining, attractive, and novel. The karaoke card can be used with various musical and spoken arrangements and appeals to the greeting and postcard industry, as well as the postal industry or any user that employs the usage of cards for correspondence.

BRIEF SUMMARY OF THE INVENTION

In view of the foregoing background, it is therefore an object of the present invention to provide a karaoke card. These and other objects, features, and advantages of the invention are provided by a card for greeting a user by employing a sing-along.

The device includes a body with monolithically and pivotally conjoined first and second sections. Such a body is conveniently formed from disposable material. The second section includes directly conjoined front and rear portions each having coextensive shapes. Each of the front and rear portions include a monolithically formed finger protruding orthogonally from respective longitudinal axes thereof. One of the fingers travels rearwardly and another of the fingers travels forwardly in such a manner that the fingers interlock to maintain the body at a unitary position. Such front and rear portions define at least one cavity therebetween.

The cavity effectively extends horizontally along a width of the front and rear portions. The front portion further has a notch formed therein. The notch penetrates through a thickness of the front portion and is in fluid communication with the cavity. The rear portion further has a slot advantageously formed therein which is vertically aligned with the notch and situated rearward of the cavity such that the cavity is in fluid communication with the slot during operating conditions. A mechanism is included for audibly playing a song when the first and second sections are articulated to an open position.

Another mechanism is also included for conveniently illuminating a selected portion of the cavity while the audible song playing mechanism is activated such that a user can visually identify associated lyrics of the song and thereby sing in sync with the song. The illuminating mechanism advantageously lights up the lyrics of the song in real-time as the song is played. The audible song playing mechanism and the illuminating mechanism are independently operable.

Such an audible song playing mechanism preferably includes a processor. A speaker is electrically mated to the processor. A memory is electrically mated to the processor. Such a memory advantageously includes at least one audible file stored thereon for playback. A switch is operably connected to a power supply. The switch is conveniently toggled between open and closed positions when the first and second sections are articulated beyond a predetermined threshold.

The illuminating mechanism includes a processor, a plurality of LEDs electrically coupled in parallel, a transparent film having a predetermined tint and intercalated within the cavity, and a voice synchronizer electrically mated to the processor, the speaker and the LEDs. A memory is included which preferably contains software instructions for causing the musical gift card to perform the predetermined steps of: identifying a beginning note of the song, identifying a lyric associated with the beginning note, identifying an ending note of the song, and identifying a lyric associated with the ending note.

The processor may effectively generate and transmit an output signal to the voice synchronizer for controlling a speed and operating mode of the LEDs so that the user can sing along with the song during playback conditions. A power supply source is electrically mated in parallel to the LEDs. Selected ones of the LEDs are nested within the slot and situated posterior of the transparent film. A plurality of inserts are preferably positioned within the notch. Such inserts include surface indicia thereon for identifying musical notes associated with the song. The front portion may further have surface indicia printed thereon for identifying the lyrics associated with the song.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
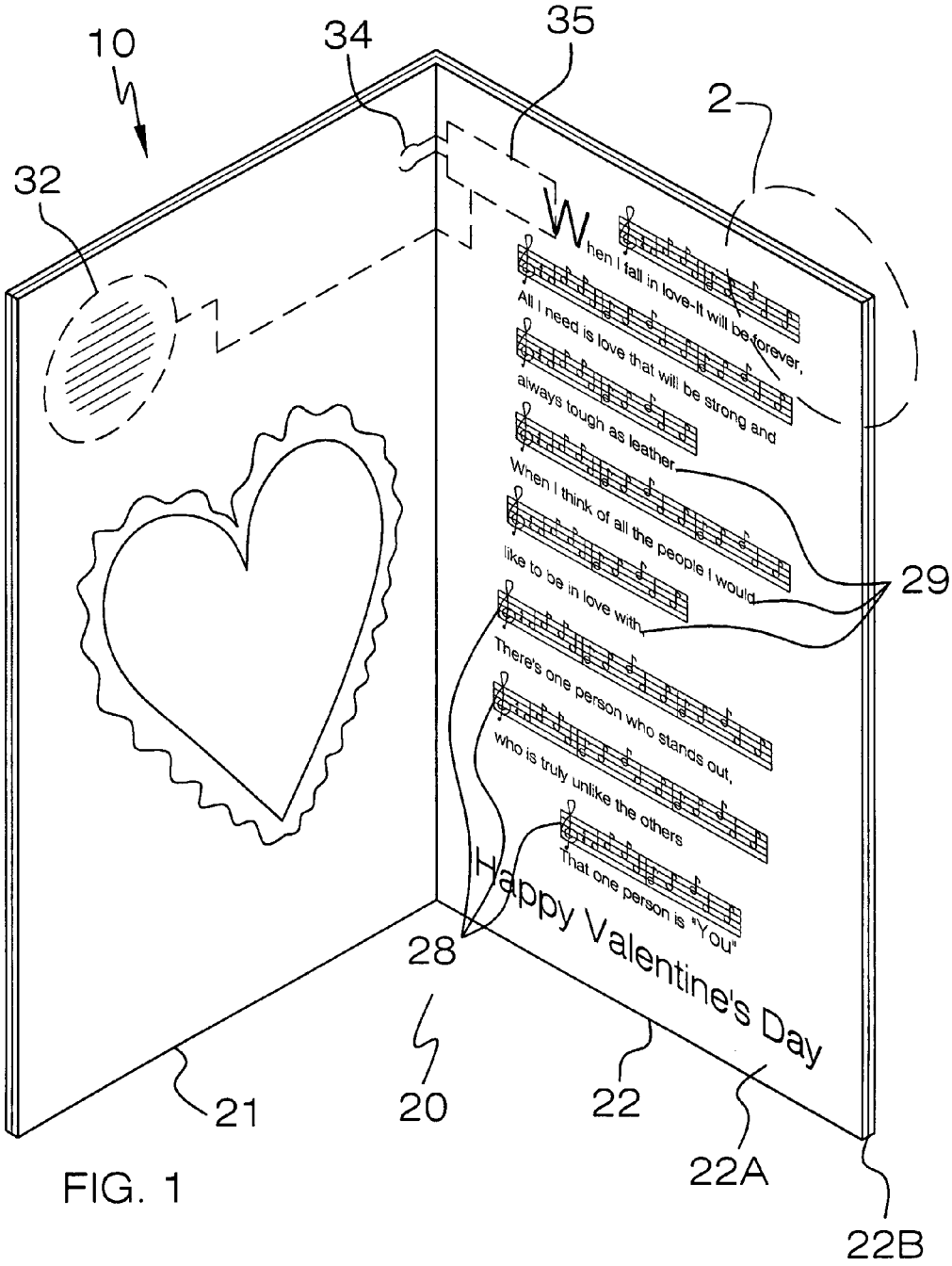
FIG. 1 is a perspective view showing a karaoke greeting card, in accordance with the present invention.
Figure 2:
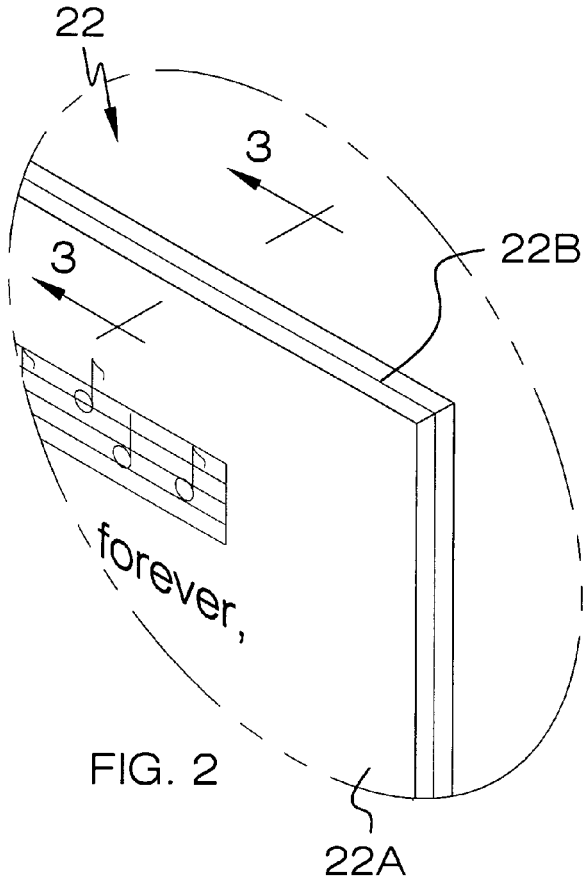
FIG. 2 is an enlarged view of section 2 as shown in FIG. 1.
Figure 3:
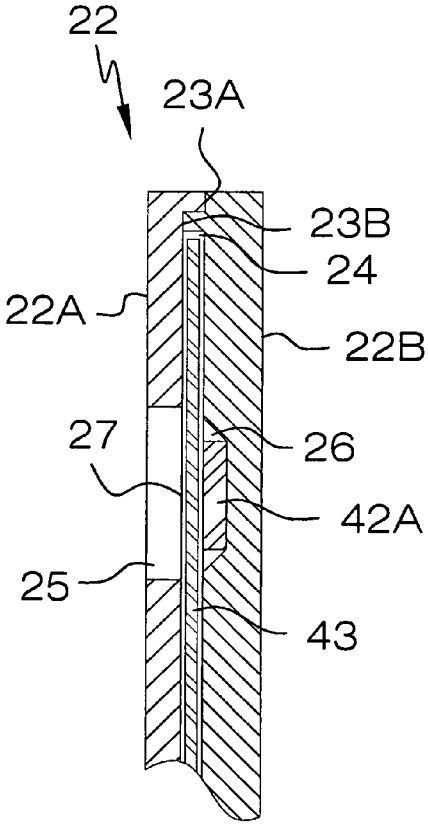
FIG. 3 is a cross sectional view of the device as shown in FIG. 2, taken along line 3-3.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1-6 by the reference numeral 10 and is intended to provide a karaoke card. It should be understood that the device 10 may be used for many different types of texts and should not be limited in use only to cards. Initially referring to FIGS. 1-3, the device 10 includes a body 20 having pivotally conjoined first 21 and second sections 22, with no intervening elements. The first 21 and second sections 22 are monolithically formed from the body 20. Such a body 20 is conveniently formed from disposable material. Front 22A and rear portions 22B each having coextensive shapes are directly conjoined, with no intervening elements, to the second section 22.

Each of the front 22A and rear portions 22B include a monolithically formed finger 23A, 23B protruding orthogonally from respective longitudinal axes thereof. The monolithically formed fingers are essential to the device 10 as they allow for the inexpensive and rapid manufacture of the device 10, thereby increasing the simplicity of the device 10 by forming a locking means without the use of complex arrangements or costly materials. One of the fingers 23A travels rearwardly and another of the fingers 23B travels forwardly in such a manner that the fingers 23A, 23B interlock to maintain the body 20 at a unitary position. Again, this is critical to the invention as it allows the device 10 to effectively maintain its shape without the need for costly materials and while being able to maintain the enclosure necessary for other mechanisms in the device to function without being exposed. Such front 22A and rear portions 22B define at least one cavity 24 therebetween.

The cavity 24 is an important feature of the invention as it houses the transparent film 43 [described herein below] which allows for customization of the device. The cavity 24 effectively extends horizontally along a width of the front 22A and rear 22B portions. The front portion 22A further has a notch 25 formed therein. The notch 25 penetrates through a thickness of the front portion 22A and is in fluid communication with the cavity 24. The rear portion 22B further has a slot 26 advantageously formed therein which is vertically aligned with the notch 25 and situated rearward of the cavity 24 such that the cavity 24 is in fluid communication with the slot 26 during operating conditions.

Figure 6:
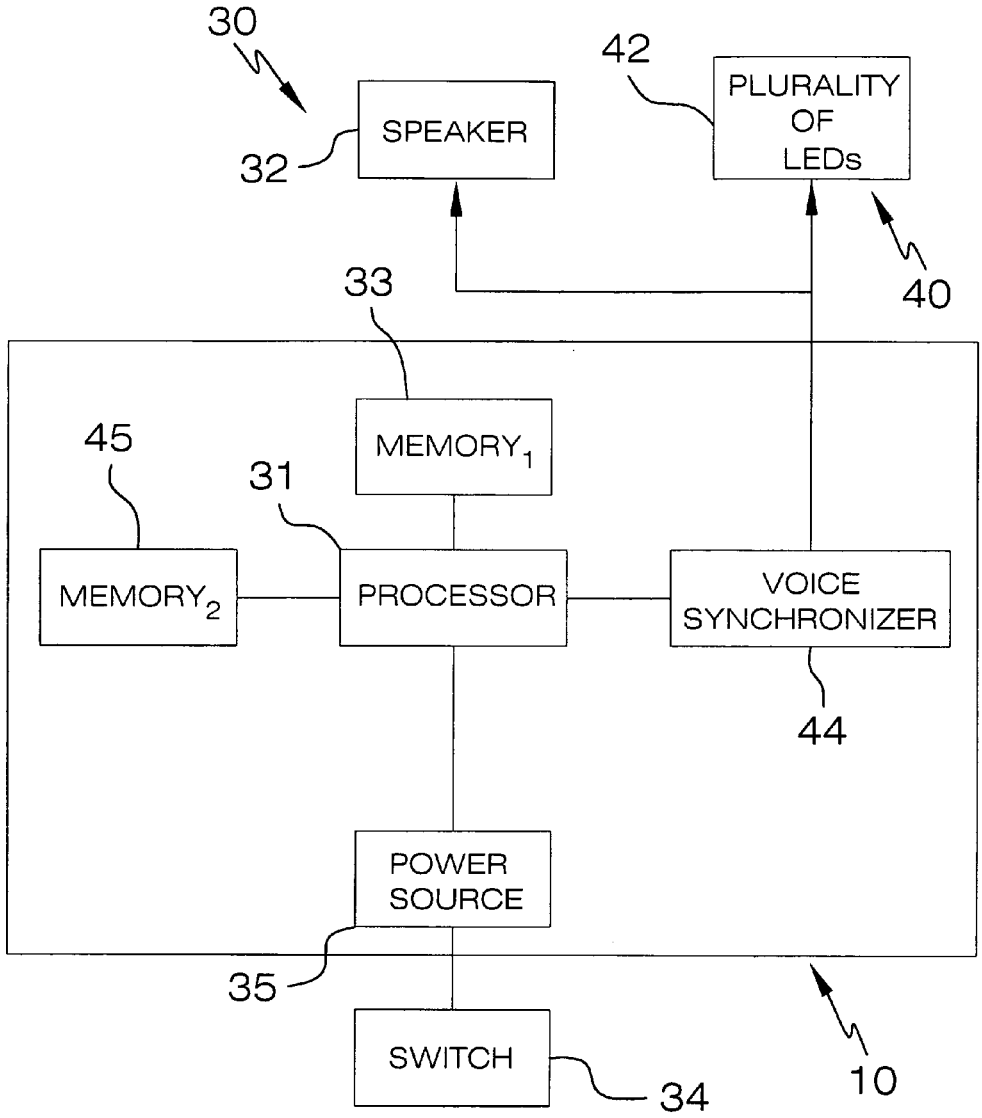
FIG. 6 is a schematic block diagram of the device showing the illuminating and audible song playback mechanisms.

Referring to FIG. 6, a mechanism 30 is included for audibly playing a song when the first 21 and second 22 sections are articulated to an open position. Another mechanism 40 is also included for conveniently illuminating a selected portion of the cavity 24 while the audible song playing mechanism 30 is activated such that a user can visually identify associated lyrics of the song and thereby sing in sync with the song. By allowing the user to advantageously identify the lyrics to the song being played, the user is able to enjoy the device 10 to a much greater extent.

The illuminating mechanism 40 advantageously lights up the lyrics of the song in real-time as the song is played. This feature is absolutely critical to the invention as the simultaneous operation of the illuminating mechanism and the audible song playing mechanism creates a synergistic effect which produces a highly entertaining environment for the user. The audible song playing mechanism 30 and the illuminating mechanism 40 are independently operable.

Figure 4:
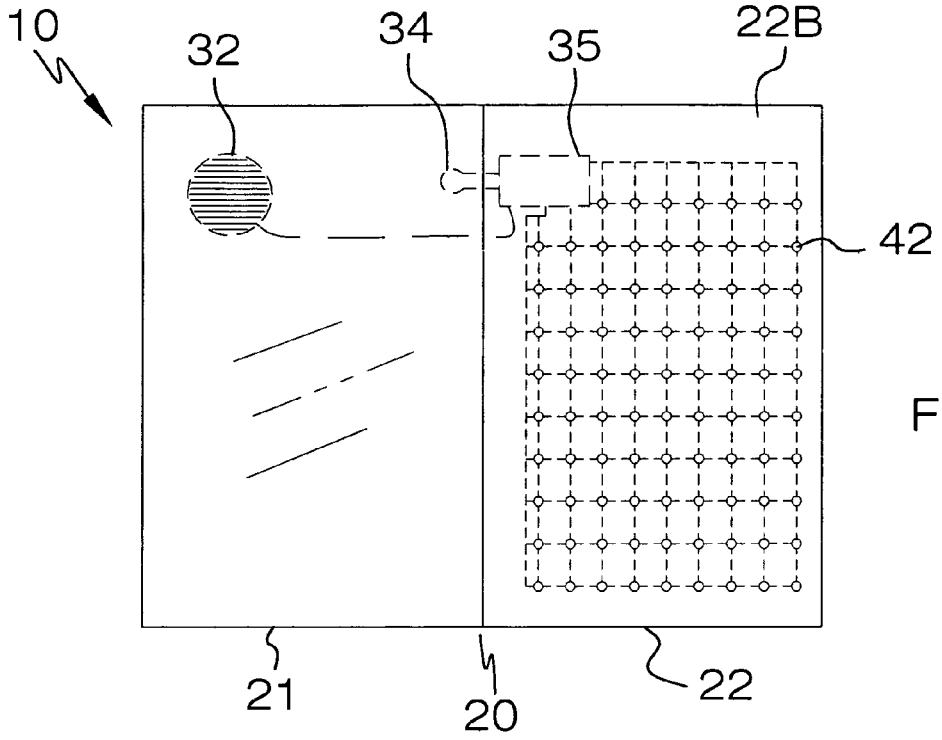
FIG. 4 is a rear elevational view of the device as shown in FIG. 1, showing the plurality of LEDs, the speaker, and the switch in hidden lines.
Figure 5:
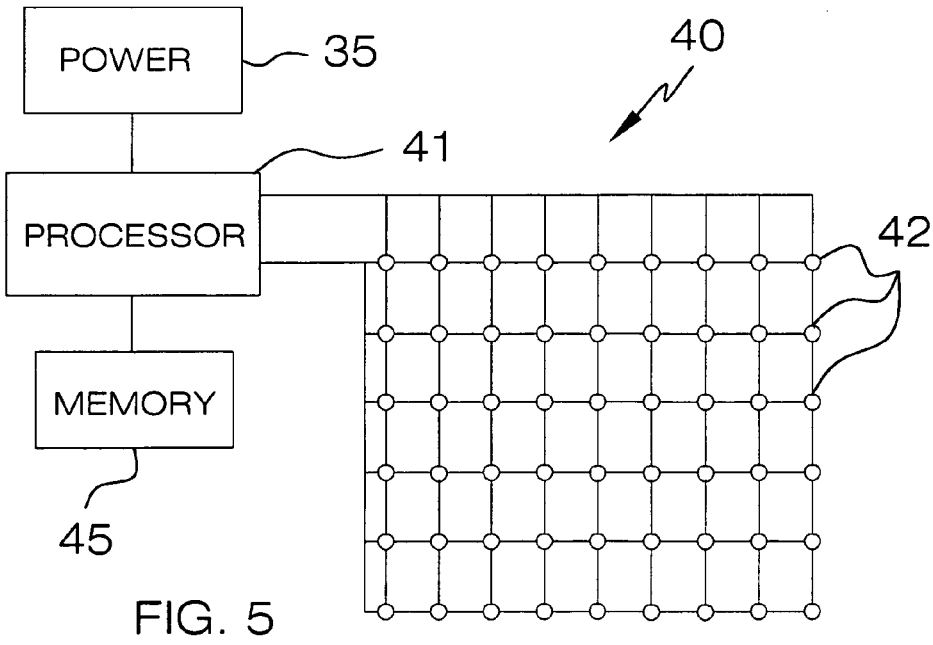
FIG. 5 is a partial schematic block diagram of the device showing the illuminating mechanism.

Referring to FIGS. 1, 4, and 6, such an audible song playing mechanism 30 includes a processor 31. A speaker 32 is electrically mated to the processor 31. A memory 33 is electrically mated to the processor 31. Such a memory 33 advantageously includes at least one audible file stored thereon for playback. A switch 34 is operably connected to a power supply 35. The switch 34 is conveniently toggled between open and closed positions when the first 21 and second 22 sections are articulated beyond a predetermined threshold. This feature is important as it allows for the operation of the device 10 without any prior user knowledge.

Referring to FIGS. 3-6, the illuminating mechanism 40 includes a processor 31, a plurality of LEDs 42 electrically coupled in parallel, a transparent film 43 having a predetermined tint and intercalated within the cavity 24, and a voice synchronizer 44 electrically mated to the processor 31, the speaker 32 and the LEDs 42. A memory 45 is included which contains software instructions for causing the device 10 to perform the predetermined steps of: identifying a beginning note of the song, identifying a lyric associated with the beginning note, identifying an ending note of the song, and identifying a lyric associated with the ending note.

The processor 31 effectively generates and transmits an output signal to the voice synchronizer 44 for controlling a speed and operating mode of the LEDs 42 so that the user can sing along with the song during playback conditions. A power supply source 35 is electrically mated in parallel to the LEDs 42. Selected ones of the LEDs 42A are nested within the slot 26 and situated posterior of the transparent film 43. A plurality of inserts 27 are preferably positioned within the notch 25. Such inserts 27 include surface indicia 28 thereon for identifying musical notes associated with the song. The notch 25 is essential to the invention as it permits the placement of musical indicia associated with the song. The front portion 22A may further have surface indicia 29 printed thereon for identifying the lyrics associated with the song. It is noted that brail surface indicia is preferably included beneath the alphabetic surface indicia so that a blind user can sing along during playback conditions.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A musical gift card for providing user enjoyment, said musical gift card comprising:

a body including monolithically and pivotally conjoined first and second sections, said second section including directly conjoined front and rear portions having coextensive shapes, each said front and rear portions including a monolithically formed finger protruding orthogonally from respective longitudinal axes thereof, one said fingers traveling rearwardly and another said fingers traveling forwardly in such a manner that said fingers interlock for maintaining said body at a unitary position, said front and rear portions defining at least one cavity therebetween, the cavity extending horizontally along a width of said front and rear portions, said front portion further having a notch formed therein, the notch penetrating through a thickness of said front portion and being in fluid communication with the cavity, said rear portion further having a slot formed therein, the slot being vertically aligned with the notch and situated rearward of the cavity such that the cavity is in fluid communication with the slot during operating conditions;

means for audibly playing a song when said first and second sections are articulated to an open position; and means for illuminating a selected portion of the cavity while the audible song playing means is activated such that a user can visually identify associated lyrics of the song and thereby sing in sync with the song, wherein said illuminating means lights up the lyrics of the song in real-time as the song is being played.

2. The musical gift card of claim 1, wherein said audible song playing means comprises:

a processor;

a speaker electrically mated to said processor;

a memory electrically mated to said processor, said memory including at least one audible file stored thereon for playback;

a switch; and a power supply source operably connected to said switch, said switch being toggled between open and closed positions when said first and second sections are articulated beyond a predetermined threshold.

3. The musical gift card of claim 1, wherein said illuminating means comprises:

a processor;

a plurality of LEDs electrically coupled in parallel;

a transparent film having a predetermined tint and being intercalated within the cavity;

a voice synchronizer electrically mated to said processor, said speaker and said LEDs;

a memory including software instructions for causing said musical gift card to perform the predetermined step of identifying a beginning note of the song, identifying a lyric associated with the beginning note, identifying a ending note of the song, and identifying a lyric associated with the ending note, wherein said processor generates and transmits an output signal to said voice synchronizer for controlling a speed and operating mode of said LEDs so that the user can sing along with the song during playback conditions; and a power supply source electrically mated in parallel to said LEDs.

4. The musical gift card of claim 3, wherein selected ones of said LEDs are nested within the slot and situated posterior of said transparent film.

5. The musical gift card of claim 1, further comprising: a plurality of inserts positioned within the notch, said inserts including surface indicia thereon for identifying musical notes associated with the song.

6. The musical gift card of claim 1, wherein said front portion further has surface indicia printed thereon for identifying the lyrics associated with the song.

7. A musical gift card for providing user enjoyment, said musical gift card comprising:

a body including monolithically and pivotally conjoined first and second sections, said second section including directly conjoined front and rear portions having coextensive shapes, each said front and rear portions including a monolithically formed finger protruding orthogonally from respective longitudinal axes thereof, one said fingers traveling rearwardly and another said fingers traveling forwardly in such a manner that said fingers interlock for maintaining said body at a unitary position, said front and rear portions defining at least one cavity therebetween, the cavity extending horizontally along a width of said front and rear portions, said front portion further having a notch formed therein, the notch penetrating through a thickness of said front portion and being in fluid communication with the cavity, said rear portion further having a slot formed therein, the slot being vertically aligned with the notch and situated rearward of the cavity such that the cavity is in fluid communication with the slot during operating conditions;

means for audibly playing a song when said first and second sections are articulated to an open position; and means for illuminating a selected portion of the cavity while the audible song playing means is activated such that a user can visually identify associated lyrics of the song and thereby sing in sync with the song, wherein said illuminating means lights up the lyrics of the song in real-time as the song is being played, wherein said audible song playing means and said illuminating means are independently operable.

8. The musical gift card of claim 7, wherein said audible song playing means comprises:

a processor;

a speaker electrically mated to said processor;

a memory electrically mated to said processor, said memory including at least one audible file stored thereon for playback;

a switch; and a power supply source operably connected to said switch, said switch being toggled between open and closed positions when said first and second sections are articulated beyond a predetermined threshold.

9. The musical gift card of claim 7, wherein said illuminating means comprises:

a processor;

a plurality of LEDs electrically coupled in parallel;

a transparent film having a predetermined tint and being intercalated within the cavity;

a voice synchronizer electrically mated to said processor, said speaker and said LEDs;

a memory including software instructions for causing said musical gift card to perform the predetermined step of identifying a beginning note of the song, identifying a lyric associated with the beginning note, identifying a ending note of the song, and identifying a lyric associated with the ending note, wherein said processor generates and transmits an output signal to said voice synchronizer for controlling a speed and operating mode of said LEDs so that the user can sing along with the song during playback conditions; and a power supply source electrically mated in parallel to said LEDs.

10. The musical gift card of claim 9, wherein selected ones of said LEDs are nested within the slot and situated posterior of said transparent film.

11. The musical gift card of claim 7, further comprising: a plurality of inserts positioned within the notch, said inserts including surface indicia thereon for identifying musical notes associated with the song.

12. The musical gift card of claim 7, wherein said front portion further has surface indicia printed thereon for identifying the lyrics associated with the song.

13. A musical gift card for providing user enjoyment, said musical gift card comprising:

a body formed from disposable material including monolithically and pivotally conjoined first and second sections, said second section including directly conjoined front and rear portions having coextensive shapes, each said front and rear portions including a monolithically formed finger protruding orthogonally from respective longitudinal axes thereof, one said fingers traveling rearwardly and another said fingers traveling forwardly in such a manner that said fingers interlock for maintaining said body at a unitary position, said front and rear portions defining at least one cavity therebetween, the cavity extending horizontally along a width of said front and rear portions, said front portion further having a notch formed therein, the notch penetrating through a thickness of said front portion and being in fluid communication with the cavity, said rear portion further having a slot formed therein, the slot being vertically aligned with the notch and situated rearward of the cavity such that the cavity is in fluid communication with the slot during operating conditions;

means for audibly playing a song when said first and second sections are articulated to an open position; and means for illuminating a selected portion of the cavity while the audible song playing means is activated such that a user can visually identify associated lyrics of the song and thereby sing in sync with the song, wherein said illuminating means lights up the lyrics of the song in real-time as the song is being played, wherein said audible song playing means and said illuminating means are independently operable.

14. The musical gift card of claim 13, wherein said audible song playing means comprises:

a processor;

a speaker electrically mated to said processor;

a memory electrically mated to said processor, said memory including at least one audible file stored thereon for playback;

a switch; and a power supply source operably connected to said switch, said switch being toggled between open and closed positions when said first and second sections are articulated beyond a predetermined threshold.

15. The musical gift card of claim 13, wherein said illuminating means comprises:

a processor;

a plurality of LEDs electrically coupled in parallel;

a transparent film having a predetermined tint and being intercalated within the cavity;

a voice synchronizer electrically mated to said processor, said speaker and said LEDs;

a memory including software instructions for causing said musical gift card to perform the predetermined step of identifying a beginning note of the song, identifying a lyric associated with the beginning note, identifying a ending note of the song, and identifying a lyric associated with the ending note, wherein said processor generates and transmits an output signal to said voice synchronizer for controlling a speed and operating mode of said LEDs so that the user can sing along with the song during playback conditions; and a power supply source electrically mated in parallel to said LEDs.

16. The musical gift card of claim 15, wherein selected ones of said LEDs are nested within the slot and situated posterior of said transparent film.

17. The musical gift card of claim 13, further comprising: a plurality of inserts positioned within the notch, said inserts including surface indicia thereon for identifying musical notes associated with the song.

18. The musical gift card of claim 13, wherein said front portion further has surface indicia printed thereon for identifying the lyrics associated with the song.

* * * * *